US008294643B2

(12) United States Patent
Chang et al.

(10) Patent No.: US 8,294,643 B2
(45) Date of Patent: Oct. 23, 2012

(54) PIXEL OF DISPLAY

(75) Inventors: Yi-Cheng Chang, Taipei (TW); Kuo-Sheng Lee, Yongkang (TW)

(73) Assignee: Au Optronics Corp., Hsin-Chu (TW)

( * ) Notice: Subject to any disclaimer, the term of this patent is extended or adjusted under 35 U.S.C. 154(b) by 1588 days.

(21) Appl. No.: 11/120,982

(22) Filed: May 4, 2005

(65) Prior Publication Data

US 2006/0092106 A1 May 4, 2006

(30) Foreign Application Priority Data

Oct. 22, 2004 (TW) ..... 93132191 A

(51) Int. Cl.
*G09G 3/32* (2006.01)
*G09G 3/30* (2006.01)

(52) U.S. Cl. ..... 345/82; 345/76

(58) Field of Classification Search ..... 345/76–84
See application file for complete search history.

(56) References Cited

U.S. PATENT DOCUMENTS 6,693,385 B2 2/2004 Koyama
7,126,566 B2 * 10/2006 Lo ..... 345/76
2003/0112208 A1 * 6/2003 Okabe et al. ..... 345/82
2003/0179166 A1 * 9/2003 Li ..... 345/84
2004/0070557 A1 * 4/2004 Asano et al. ..... 345/76
2004/0130513 A1 * 7/2004 Miyazawa ..... 345/76
2005/0007318 A1 * 1/2005 Kasai et al. ..... 345/76
2005/0140605 A1 * 6/2005 Jung ..... 345/76
2005/0243033 A1 * 11/2005 Kim et al. ..... 345/76

FOREIGN PATENT DOCUMENTS

TW 536691 6/2003

* cited by examiner

*Primary Examiner* — Waseem Moorad
(74) *Attorney, Agent, or Firm* — Rabin & Berdo, P.C.

(57) ABSTRACT

A pixel of display is used in an Organic light emitted diode (OLED) display. Driving Circuit of the OLED display outputs a data current and a scanning signal. The pixel of display includes a switch circuit, a first transistor, a second transistor, a capacitor, a switch and a lighting emitting element. The switch circuit, which is controlled by the scanning signal, includes an input end for receiving the data current. When the scanning signal is enabled, a first and a second ends of the switch circuit respectively output a first and a second currents. The second current charges the capacitor. The voltage between the gate and the source of the first transistor is stored in the capacitor. When the scanning signal is disabled, the switch is turned on. The first and the second transistors respectively output currents corresponding to the cross-voltage of the capacitor to the lighting emitting element.

23 Claims, 4 Drawing Sheets

PIXEL OF DISPLAY

This application claims the benefit of Taiwan application Serial No. 93132191, filed Oct. 22, 2004, the subject matter of which is incorporated herein by reference.

BACKGROUND OF THE INVENTION

1. Field of the Invention

The invention relates in general to a pixel of display, and more particularly to an organic light emitting diode (OLED) display pixel.

2. Description of the Related Art

Referring to FIG. 1, a circuit diagram of a conventional organic light emitting diode (OLED) display pixel is shown. OLED pixel 100 comprises a first transistor Q1, a second transistor Q2, a third transistor Q3, a fourth transistor Q4, a capacitor C, and an organic light emitting diode. The current driving method of the OLED pixel 100 is disclosed below. The driving circuit (not shown in FIG. 1) provides various currents (a constant source current is exemplified here) according to various gray values, so the pixel 100 generates a corresponding voltage Vc across capacitor C according to the data current I of the constant source current output. That is to say, when the current that flows through the first transistor Q1 is almost equal to the data current I, the voltage Vgs1 between the gate and the source of the first transistor Q1 corresponding to the current flowing through the first transistor Q1 is stored at the capacitor C and becomes a capacitor cross-voltage Vc. Therefore, when the scanning signal S is disabled, the third transistor 03, the fourth transistor Q4 and the first transistor Q1 are all turned off. Given that the first transistor Q1 and the second transistor Q2 have the same characteristics, and that the capacitor cross-voltage Vc is almost maintained at the level of the voltage Vgs1, the voltage Vgs2 between the gate and the source of the second transistor Q2 would be substantially equal to the voltage Vgs1, meanwhile, the current flowing through the second transistor Q2 would be theoretically equal to the data current I.

In practice, shift in the threshold voltage would occur to the transistor after long duration of operation. The shift has much to do with the operation time of the transistor and the volume of the current flowing through. The turn-on duration of the first transistor Q1 is different from that of the second transistor Q2, because the second transistor Q2 is always turned on. The second transistor Q2 is turned on no matter the scanning signal S is enabled or disabled, while the first transistor Q1 is turned on only when the scanning signal S is enabled. Therefore, the shift in the threshold voltage of conduction for the first transistor Q1 is different from that for the second transistor Q2. The voltage Vgs2 between the gate and the source of the second transistor Q2 and the voltage Vgs1 between the gate and the source of the first transistor may both be equal to the capacitor cross-voltage Vc, but the shift in the threshold voltage for the first transistor Q1 is different from that for the second transistor Q2, resulting in different threshold voltages between the second transistor Q2 and the first transistor Q1. Consequently, the volume of the current generated by the second transistor Q2 would be different from the data current I, preventing the OLED luminance from achieving the corresponding luminance of the data current I.

SUMMARY OF THE INVENTION

It is therefore an object of the invention to provide a pixel of display to resolve the problem that under the same gate-source voltage generated when the first transistor and the second transistor have different shifts in threshold voltage, the current generated by the second transistor is different from the current generated by the first transistor.

The invention achieves the above-identified object by providing a pixel of a display, comprising a switch circuit, a first transistor, a second transistor, a switch, a capacitor, and a lighting emitting element. The switch circuit is for receiving a data signal, and providing a first and a second current according to the data signal when a scanning signal is enabled. The first transistor is for receiving the first current and being coupled to a node. The second transistor is for receiving a first constant voltage and being coupled to the node. The switch is for receiving a second constant voltage and is controlled by a controlling signal corresponding to the scanning signal, and the first transistor receives the current from the switch when the scanning signal is disabled. The capacitor is for receiving the second current. The currents outputted from the first and second transistors are corresponding to the voltage across the capacitor. The first current and the second current vary with the voltage across the capacitor. The lighting emitting element is coupled to the node for receiving the current outputted from the first transistor and the second transistor.

It is therefore another object of the invention to provide an organic light emitting diode (OLED) display, comprising a driving circuit and a plurality of pixels. The driving circuit outputs a data signal and a scanning signal. Each of the plurality of pixels comprises a switch circuit, a first transistor, a second transistor, a switch, a capacitor, and a lighting emitting element. The switch circuit is for receiving the data signal, and providing a first and a second current according to the data signal when the scanning signal is enabled. The first transistor is for receiving the first current and being coupled to a node. The second transistor is for receiving a first constant voltage and being coupled to the node. The switch is for receiving a second constant voltage and is controlled by a controlling signal corresponding to the scanning signal, and the first transistor receives the current from the switch when the scanning signal is disabled. The capacitor is for receiving the second current. The currents outputted from the first and second transistors are corresponding to the voltage across the capacitor. The first current and the second current vary with the voltage across the capacitor. The lighting emitting element is coupled to the node for receiving the current outputted from the first transistor and the second transistor.

Other objects, features, and advantages of the invention will become apparent from the following detailed description of the preferred but non-limiting embodiments. The following description is made with reference to accompanying drawings.

DETAILED DESCRIPTION OF THE INVENTION

Figure 2:
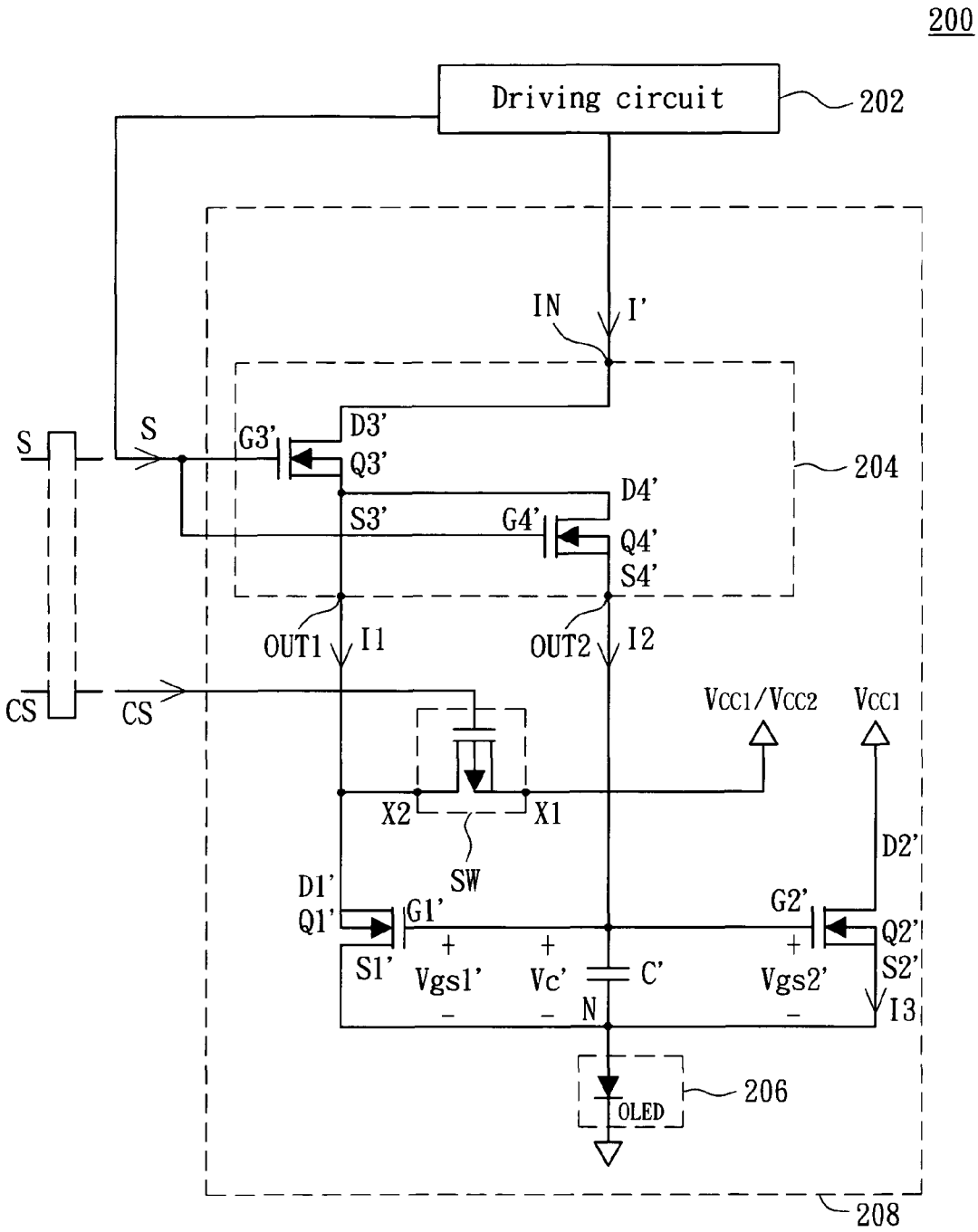
FIG. 2 is a circuit diagram of an OLED display according to a first embodiment of the invention.

Referring to FIG. 2, a circuit diagram of an OLED display according to a first embodiment of the invention is shown. OLED display 200 comprises a driving circuit 202 and a plurality of pixels such as a pixel 208. The driving circuit 202 outputs a data current I' and a scanning signal S. The pixel 208 comprises a switch circuit 204, a first transistor Q1', a second transistor Q2', a switch SW, a capacitor C' and a lighting emitting element 206. The switch circuit 204 has a third transistor Q3' and a fourth transistor Q4'. Moreover, the first transistor Q1', the second transistor Q2', the third transistor Q3' and the fourth transistor Q4' are preferably N-type amorphous silicon thin film transistors, and each has a drain, a gate and a source. Their relationship is disclosed below. The third gate G3' of the third transistor Q3' is for receiving the scanning signal S, the third drain D3' of the third transistor Q3' is used as an input end IN of the switch circuit 204 to receive the data current I', while the third source S3 of the third transistor Q3' is used as a first output end OUT1 of the switch circuit 204. The fourth drain D4' of the fourth transistor Q4'is coupled to the third source S3', the fourth gate G4' of the fourth transistor Q4' is for receiving the scanning signal S, and the fourth source S4' of the fourth transistor Q4' is used as a second output end OUT2 of the switch circuit 204.

The first drain D1' of the first transistor Q1' is coupled to the first output end OUT1, the first gate G1' of the first transistor Q1' is coupled to the second output end OUT2, and the first source S1' of the first transistor Q1' is coupled to a node N. The second drain D2' of the second transistor Q2' is coupled to the first constant voltage Vcc1, the second gate G2' of the second transistor Q2' is coupled to the second output end OUT2, and the second source S2' of the second transistor Q2' is coupled to the node N. The switch SW has a first end X1 and a second end X2, wherein the switch SW is preferably a P-type amorphous silicon thin film transistor, the first end X1 is coupled to the second constant voltage Vcc2, and the second constant voltage Vcc2 is preferably of the same voltage with the first constant voltage Vcc1. The second end X2 is coupled to the first output end OUT1.

One end of the capacitor C' is coupled to the second output end OUT2, another end of the capacitor C' together with a positive end of a lighting emitting element 206 are coupled to a node N. The lighting emitting element 206 is an organic light emitting diode (OLED).

Firstly, when the scanning signal S is just enabled, most of the data currents I' flow to the OLED 206 through the fourth transistor Q4', the capacitor C' to quickly charge the capacitor C'. When the voltage Vc' across the capacitor C' is increased to a level larger than the threshold voltage of the first transistor Q1', the first transistor Q1' is turned on, then the data current I' is flows through the third transistor Q3' and the fourth transistor Q4' at the same time. The first current I1 is outputted at the first output end OUT1 and the second current I2 is outputted at the second output end OUT2. Since the threshold voltage of the first transistor Q1' and that of the second transistor Q2' are substantially the same, when the first transistor Q1' is turned on, the second transistor Q2' is turned on as well. When the voltage Vc' is increased, the volume of the first current I1 is increased accordingly. Meanwhile, when the second transistor Q2' is turned on, like the first current I1*a*, the third current I3 flowing through the second transistor Q2' is also increased along with the increase in the voltage Vc'. When the increase in the voltage Vc' suffices the first current I1' to be almost equal to the data current I', the voltage between the gate and the source of the first transistor Q1' is Vgs1' and the voltage Vc' is equal to Vgs1', therefore the voltage between the gate G1' and the source S1' of the first transistor Q1' is maintained at the level of Vgs1'.

Figure 1:
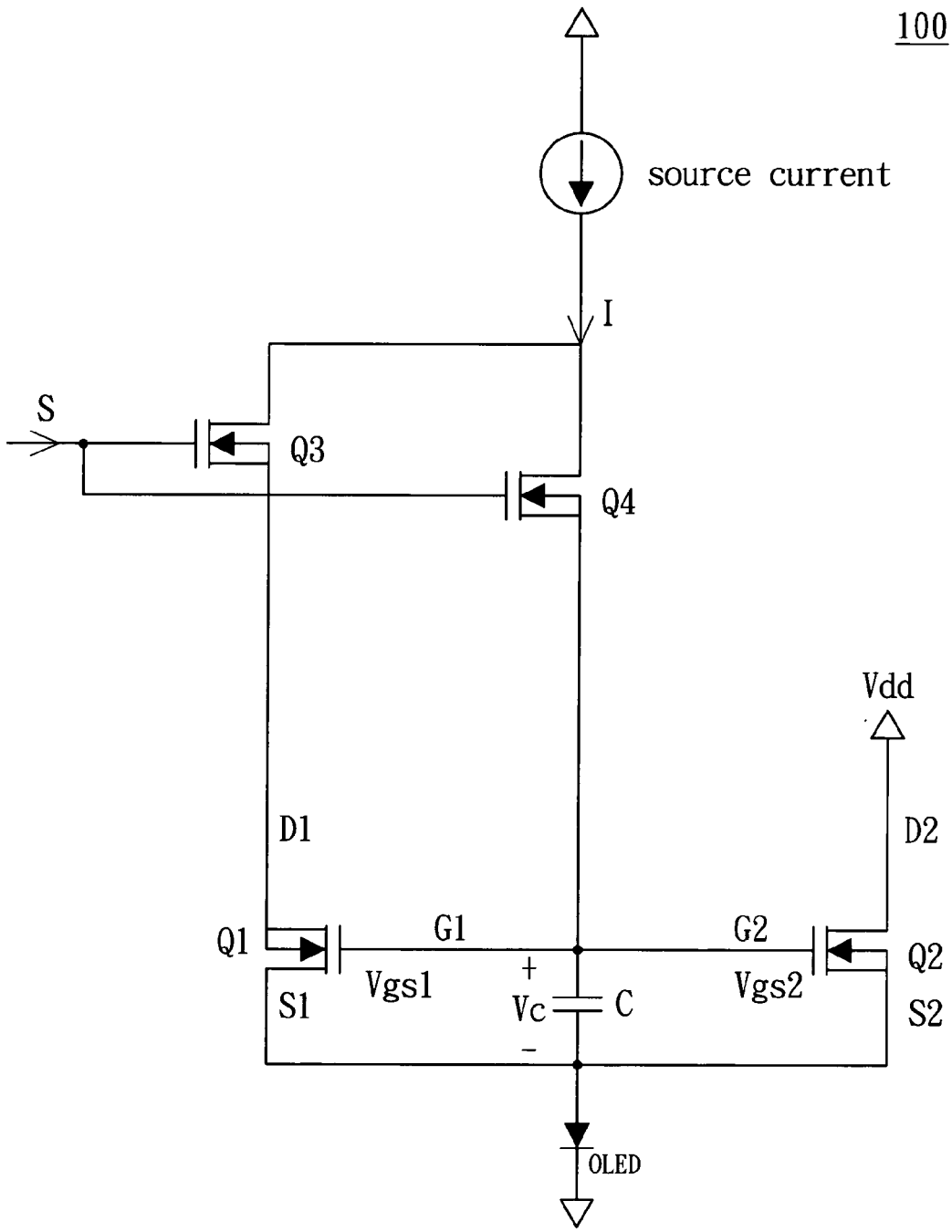
FIG. 1(PRIOR ART)
FIG. 1 a circuit diagram of a conventional organic light emitting diode (OLED) pixel.

Next, when the scanning signal S is disabled, both the third transistor Q3' and the fourth transistor Q4' are turned off. Since the controlling signal CS and the scanning signal S are of opposite phases, the scanning signal S is disabled, but the controlling signal CS is enabled so the switch SW is turned on. Meanwhile, since the voltage difference between the gate G1'—the source S1' of the first transistor Q1' and the voltage difference between the gate G2'—the source S2' of the second transistor Q2' are maintained at the level of the voltage Vc', the first transistor Q1' and the second transistor 02' continue to be turned on. Meanwhile, the current of the first current I1 and that of the third current I3 respectively flowing through the first transistor Q1' and the second transistor Q2' are approximately equal to the current of the data current I', so the current received by the OLED 206 approximately doubles the data current I'. That is to say, compared with the conventional pixel in FIG. 1, for the OLED 206 to generate the same luminance, the current that flows through the first current I1 and the third current I3 of the first transistor Q1' and the second transistor Q2' in the present embodiment is only half of the current that flows through the first transistor Q1' and the second transistor Q2' in FIG. 1. The shift in the threshold voltage of transistor is proportional related to the duration of conduction and the current flowing through the transistor, so the shifting amount of the threshold voltage of the first transistor Q1' and the second transistor Q2' in the present embodiment is smaller than that in conventional pixels. Therefore, the lifespan of the pixel 208 in the present embodiment is longer than that of the pixel in FIG. 1.

Besides, when the first transistor Q1' is turned on by the switch SW when the scanning signal S is disabled, the operating time of the two transistors Q1' and Q2' are almost the same and so are their shifts in threshold voltage after long duration of operation. When the capacitor C' stores the voltage Vgs1' between the gate and the source corresponding to the current I1 flowing through the first transistor Q1', the voltage Vc' causes the second transistor Q2' to generate a current I3 substantially equal to the current I1 flowing through the first transistor Q1'. Consequently, target luminance can be generated by the pixel 208, preventing low luminance problem as would occur in conventional pixels.

Figure 3:
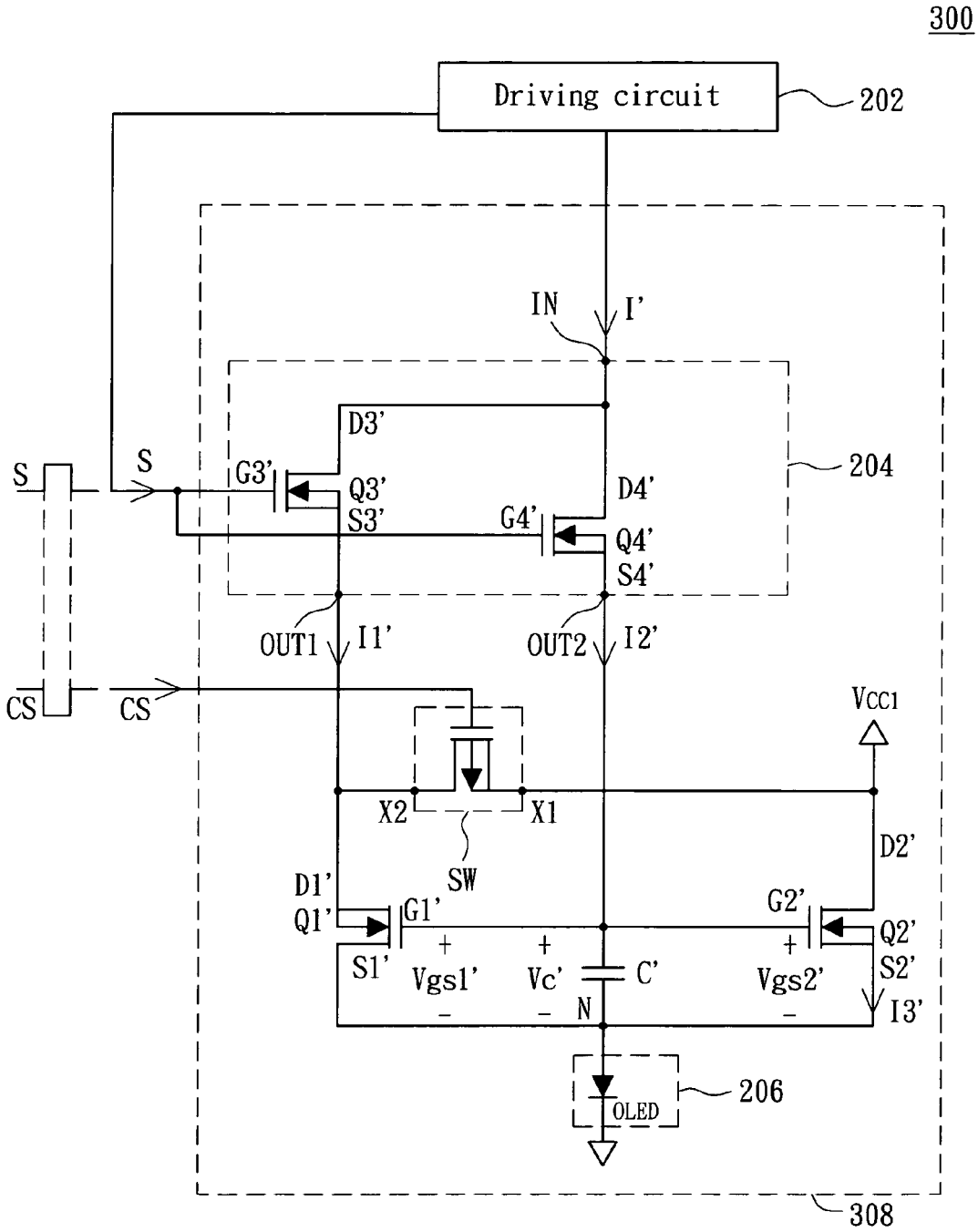
FIG. 3 is a circuit diagram of an OLED display according to a second embodiment of the invention.

Referring to FIG. 3, a circuit diagram of an OLED display according to a second embodiment of the invention is shown. The OLED display 300 in the present embodiment differs with the OLED display 200 in the first embodiment in that, the two transistors Q3', Q4' in the pixel 308 are connected in parallel rather than in serial. That is to say, the fourth drain D4' of the fourth transistor Q4' is coupled to the third drain D3' of the third transistor Q3'. Besides, the second embodiment and the first embodiment have the same effect.

Figure 4:
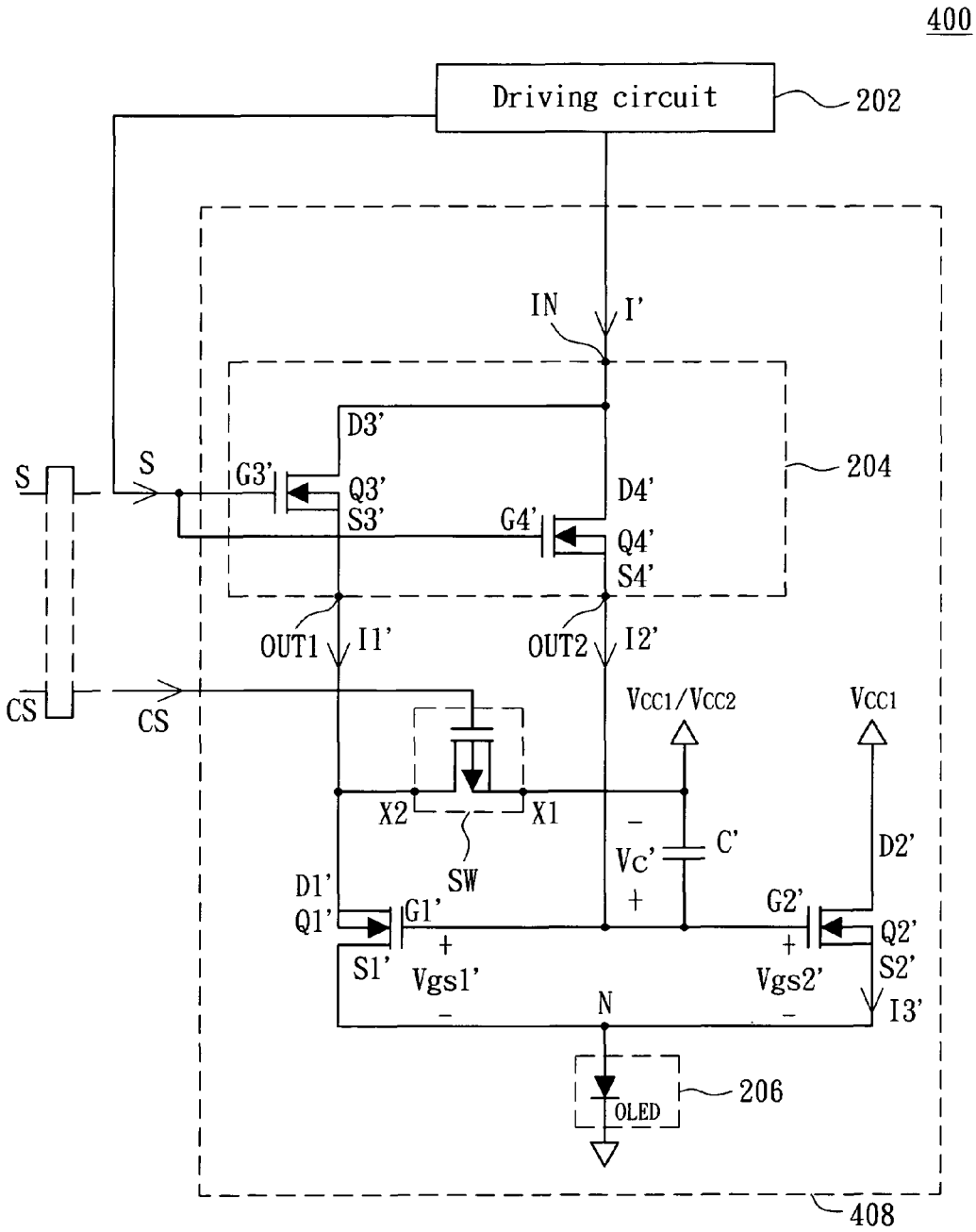
FIG. 4 is a circuit diagram of an OLED display according to a third embodiment of the invention.

Referring to FIG. 4, a circuit diagram of an OLED display according to a third embodiment of the invention is shown. The present embodiment differs with the second embodiment in the connection of the capacitor C'. The capacitor C' has one end coupled to the second output end OUT2 of the switch circuit 204 and has another end coupled to either the first constant voltage Vcc1 or the second constant voltage Vcc2, as long as the capacitor C' can store the voltage Vgs1' between the gate and the source corresponding to the current I1' of the first transistor Q1'. Besides, the connection between the third transistor Q3' and the fourth transistor Q4' can also be changed from a parallel connection to a serial connection.

The pixels disclosed in above embodiments of the invention have a data current lower than that in conventional current driving method. Furthermore, the shift in the threshold voltage of the second transistor and that of the first transistor are almost the same, so that the pixel circuit, according to different driving currents, generates a corresponding voltage between the gate and the source to be used as a voltage the cross capacitor, and that the second transistor generates a third current almost equal to the first current and provides a current substantially doubles the data current for the OLED to achieve the pre-set luminance.

While the invention has been described by way of example and in terms of a preferred embodiment, it is to be understood that the invention is not limited thereto. On the contrary, it is intended to cover various modifications and similar arrangements and procedures, and the scope of appended claims therefore should be accorded the broadest interpretation so as to encompass all such modifications and similar arrangements and procedures.

What is claimed is:

1. A pixel of a display, comprising:

a switch circuit for receiving a data signal, and providing a first and a second current according to the data signal when a scanning signal is enabled;

a first transistor for receiving the first current and being coupled to a node;

a second transistor for receiving a first constant voltage and being coupled to the node;

a switch for receiving a second constant voltage and controlled by a controlling signal corresponding to the scanning signal, wherein the switch is controlled by the controlling signal; and when the switch turns on, the switch conducts the second constant voltage to the first transistor, and the first transistor is in an on or off state according to a voltage on the node, and the current from the switch flows through the first transistor when the switches turns on and the first transistor is in the on state;

a capacitor for receiving the second current, the currents outputted from the first and second transistors corresponding to the voltage across the capacitor, wherein the first current and the second current vary with the voltage across the capacitor; and a lighting emitting element coupled to the node for receiving the current outputted from the first transistor and the second transistor, so that the light emitting element generates luminance corresponding to the data signal when the switch turns on.

2. The pixel according to claim 1, wherein the switch circuit comprises:

a third transistor being controlled by the scanning signal, for receiving the data signal and outputting the first current; and a fourth transistor being controlled by the scanning signal, for receiving a current outputted from the third transistor and outputting the second current, wherein the sum of the first current and the second current is substantially equal to the data signal.

3. The pixel according to claim 1, wherein the switch circuit comprises:

a third transistor being controlled by the scanning signal, for receiving part of the data signal and outputting the first current;

a fourth transistor being controlled by the scanning signal, for receiving another part of the data signal and outputting the second current.

4. The pixel according to claim 1, wherein one end of the capacitor is coupled to gates of the first transistor and the second transistor, and another end of the capacitor is coupled to the node, the first constant voltage or the second constant voltage.

5. The pixel according to claim 1, wherein the lighting emitting element is an organic light emitting diode.

6. The pixel according to claim 2, wherein all of the first transistor, the second transistor, the third transistor, and the fourth transistor are N-type amorphous silicon thin film transistors.

7. The pixel according to claim 1, wherein the controlling signal and the scanning signal are of opposite phases.

8. The pixel according to claim 1, wherein the controlling signal is the next scanning signal.

9. The pixel according to claim 1, wherein the first constant voltage and the second constant voltage have the same voltage.

10. An organic light emitting diode (OLED) display, comprising:

a driving circuit for outputting a data signal and a scanning signal; and a plurality of pixels, each comprising:

a switch circuit for receiving the data signal, and providing a first and a second current according to the data signal when the scanning signal is enabled;

a first transistor for receiving the first current and being coupled to a node;

a second transistor for receiving a first constant voltage and being coupled to the node;

a switch for receiving a second constant voltage and a controlling signal corresponding to the scanning signal, wherein the switch is controlled by the controlling signal; when the switch turns on, the switch conducts the second constant voltage to the first transistor; and the first transistor is in an on or off state according to a voltage on the node, and the current from the switch flows through the first transistor when the switches turns on and the first transistor is in the on state:

a capacitor for receiving the second current, the currents outputted from the first and second transistors being corresponding to the voltage across the capacitor, wherein the first current and the second current vary with the voltage across the capacitor; and a lighting emitting element coupled to the node for receiving the current outputted from the first transistor and the second transistor so that the light emitting element generates luminance corresponding to the data signal when the switch turns on.

11. The display according to claim 10, wherein the switch circuit comprises:

a third transistor being controlled by the scanning signal, for receiving the data signal and outputting the first current, and a fourth transistor being controlled by the scanning signal, for receiving a current outputted from the third transistor and outputting the second current, wherein the sum of the first current and the second current is substantially equal to the data signal.

12. The display according to claim 10, wherein the switch circuit comprises:

a third transistor being controlled by the scanning signal, for receiving part of the data signal and outputting the first current;

a fourth transistor being controlled by the scanning signal, for receiving another part of the data signal and outputting the second current.

13. The display according to claim 10, wherein one end of the capacitor is coupled to the gates of the first transistor and the second transistor, and another end of the capacitor is coupled to the node, the first constant voltage or the second constant voltage.

14. The display according to claim 10, wherein the lighting emitting element is an organic light emitting diode.

15. The display according to claim 11, wherein all of the first transistor, the second transistor, the third transistor, and the fourth transistor are N-type amorphous silicon thin film transistors.

16. The display according to claim 10, wherein the controlling signal and the scanning signal are of opposite phases.

17. The display according to claim 10, wherein the controlling signal is the next scanning signal.

18. The display according to claim 10, wherein the first constant voltage and the second constant voltage have the same voltage.

19. A pixel of a display, comprising:

a switch circuit having a input end, a first output end and a second output end, wherein the input end, which receives a data current, is controlled by a scanning signal, and when the scanning signal is enabled, the switch circuit respectively outputs a first current and a second current at the first output end and the second output end;

a first transistor having a first drain, a first gate and a first source, wherein the first drain is coupled to the first output end, the first gate is coupled to the second output end, and the first source is coupled to a node;

a second transistor having a second drain, a second gate and a second source, wherein the second drain is coupled to a first constant voltage, the second gate is coupled to the second output end, and the second source is coupled to the node;

a switch having a first end and a second end, wherein the first end is coupled to a second constant voltage, the second end is coupled to the first output end, the switch is controlled by a controlling signal corresponding to the scanning signal, the control end is coupled to the controlling signal, and when the scanning signal is enabled, the switch is turned off according to the controlling signal; and when the switch turns on, the switch conducts the second constant voltage to the first transistor;

a capacitor whose one end is coupled to the second output end, wherein a voltage across capacitor of the capacitor corresponds to the voltage between the first gate and the first source; and a lighting emitting element coupled to the node;

wherein when the scanning signal is disabled, the switch is turned on for the first transistor and the second transistor to respectively output the current corresponding to the voltage across the capacitor to the lighting emitting element, and the first transistor is in an on or off state according to a voltage on the node, and the current from the switch flows through the first transistor when the switch turns on and the first transistor is in the on state, so that the light emitting element generates luminance corresponding to the data signal when the switch turns on.

20. The pixel according to claim 1, wherein when the lighting emitting element is driven, the first and the second transistors conduct concurrently, so shifts in respective threshold voltages of the first and the second transistors are substantially the same after a long duration of operation of the pixel.

21. A pixel of a display, comprising:

a switch circuit for receiving a data signal, and providing a first and a second current according to the data signal when a scanning signal is enabled;

a first transistor for receiving the first current and being coupled to a node;

a second transistor for receiving a first constant voltage and being coupled to the node;

a switch for receiving a second constant voltage and a controlling signal corresponding to the scanning signal, wherein the switch is controlled by the controlling signal; and when the switch turns on, the switch conducts the second constant voltage to the first transistor, and the first transistor is in an on or off state according to a voltage on the node;

a capacitor for receiving the second current, the currents outputted from the first and second transistors corresponding to the voltage across the capacitor, wherein the first current and the second current vary with the voltage across the capacitor; and a lighting emitting element coupled to the node for receiving the current outputted from the first transistor and the second transistor, so that the light emitting element generates luminance corresponding to the data signal when the switch turns on.

22. An organic light emitting diode (OLED) display, comprising:

a driving circuit for outputting a data signal and a scanning signal; and a plurality of pixels, each comprising:

a switch circuit for receiving the data signal, and providing a first and a second current according to the data signal when the scanning signal is enabled;

a first transistor for receiving the first current and being coupled to a node;

a second transistor for receiving a first constant voltage and being coupled to the node;

a switch for receiving a second constant voltage and a controlling signal corresponding to the scanning signal, wherein the switch is controlled by the controlling signal; when the switch turns on, the switch conducts the second constant voltage to the first transistor; and the first transistor is in an on or off state according to a voltage on the node;

a capacitor for receiving the second current, the currents outputted from the first and second transistors corresponding to the voltage across the capacitor, wherein the first current and the second current vary with the voltage across the capacitor; and a lighting emitting element coupled to the node for receiving the current outputted from the first transistor and the second transistor so that the light emitting element generates luminance corresponding to the data signal when the switch turns on.

23. A pixel of a display, comprising:

a switch circuit having a input end, a first output end and a second output end, wherein the input end, which receives a data current, is controlled by a scanning signal, and when the scanning signal is enabled, the switch circuit respectively outputs a first current and a second current at the first output end and the second output end;

a first transistor having a first drain, a first gate and a first source, wherein the first drain is coupled to the first output end, the first gate is coupled to the second output end, and the first source is coupled to a node;

a second transistor having a second drain, a second gate and a second source, wherein the second drain is coupled to a first constant voltage, the second gate is coupled to the second output end, and the second source is coupled to the node;

a switch having a first end, a control end and a second end, wherein the first end is coupled to a second constant voltage, the second end is coupled to the first output end, the switch is controlled by a controlling signal corresponding to the scanning signal, the control end is coupled to the controlling signal, and when the scanning signal is enabled, the switch is turned off according to the controlling signal; and when the switch turns on, the switch conducts the second constant voltage to the first transistor;

a capacitor whose one end is coupled to the second output end, wherein a voltage across capacitor of the capacitor corresponds to the voltage between the first gate and the first source; and a lighting emitting element coupled to the node;

wherein when the scanning signal is disabled, the switch is turned on for the first transistor and the second transistor to respectively output the current corresponding to the voltage across the capacitor to the lighting emitting element, and the first transistor is in an on or off state according to a voltage on the node, so that the light emitting element generates luminance corresponding to the data signal when the switch turns on.

* * * * *